United States Patent [19]

Potrzuski et al.

[11] 4,043,076

[45] * Aug. 23, 1977

[54] ELECTRICAL SIGNAL MECHANISM ACTUATED IN RESPONSE TO ROTATION ABOUT ANY OF THREE AXES

[76] Inventors: Stanley G. Potrzuski, 452 Elrino St.; Walter J. Potrzuski, 9 N. Montford Ave., both of Baltimore, Md. 21224

[ * ] Notice: The portion of the term of this patent subsequent to Feb. 3, 1993, has been disclaimed.

[21] Appl. No.: 649,218

[22] Filed: Jan. 14, 1976

Related U.S. Application Data

[63] Continuation-in-part of Ser. No. 476,038, June 3, 1974, Pat. No. 3,935,669.

[51] Int. Cl.[2] ..... A63H 33/26

[52] U.S. Cl. ..... 46/228; 200/80 R

[58] Field of Search ..... 46/228; 200/80 R, 80 A; 240/7.55

[56] References Cited

U.S. PATENT DOCUMENTS

| | | | |
|---|---|---|---|
| 1,637,479 | 8/1927 | Evelyn | 46/202 |
| 2,583,273 | 1/1952 | Miller | 200/80 A |
| 3,528,659 | 9/1970 | Benham | 46/228 |
| 3,935,669 | 2/1976 | Potrzuski et al. | 46/228 |

FOREIGN PATENT DOCUMENTS

| | | | |
|---|---|---|---|
| 1,068,313 | 2/1954 | France | 240/7.55 |

*Primary Examiner*—Russell R. Kinsey
*Assistant Examiner*—Robert F. Cutting
*Attorney, Agent, or Firm*—Oblon, Fisher, Spivak, McClelland & Maier

[57] ABSTRACT

An object (baton, ball, wheel, or the like) which generates a signal (visual, audio, or the like) only when in rotation and when in rotation generates a continuous signal. A power source, a first switch which assumes its ON position in response to centrifugal force, a second switch which assumes its ON position in response to centrifugal force, and means for generating a signal, connected in series are carried in the object. The first and second switches are mounted so that both are ON when the object is in rotation about a first axis, but not when it is at rest. Third and fourth switches may be placed to be ON when the object is in rotation about second and third axes at right angles to said first axis and to each other. The switches may be closed by movement of a fluid or of sliding or rolling elements.

16 Claims, 19 Drawing Figures

ELECTRICAL SIGNAL MECHANISM ACTUATED IN RESPONSE TO ROTATION ABOUT ANY OF THREE AXES

CROSS-REFERENCE TO RELATED APPLICATIONS

This is a Continuation-in-Part application of application Ser. No. 476,038, filed June 3, 1974, now U.S. Pat. No. 3,935,669.

BACKGROUND OF THE INVENTION

1. Field of the Invention

The present invention relates generally to a centrifugally actuated signal generating object, and more particularly, the present invention relates to an object such as a toy which generates a signal only when in rotation and when in rotation generates a continuous signal. Such an object could be a tossing disc, a spinning top, a football, a spherical ball, a baton, a hula hoop, a bicycle wheel, or the like.

2. Description of the Prior Art

The prior art includes a yo-yo which includes a small battery which powers a small bulb to illuminate the yo-yo. The circuit containing the small bulb and the small battery includes a contact and a resilient metal strip. The centrifugal force resulting from the rotation of the yo-yo causes the resilient metal strip to abut the contact causing closing of the circuit.

However, applicants have found that such circuitry is generally unreliable because of the difficulty in adjusting the resilient metal strip so that the circuit is closed during rotation and remains open during periods of nonrotation. In addition, this circuitry does not appear to be adaptable for use with other toys, such as a tossing disc, a spinning top, a football, a spherical ball, a baton, a hula hoop, a bicycle wheel, or the like wherein it is desired that the object be illuminated in a continuous manner during rotation and it is further desired that there be no illumination and no drain on the battery during periods of nonrotaion.

SUMMARY OF THE INVENTION

Accordingly, it is an object of the present invention to provide an object which generates a signal only when in rotation and when in rotation generates a continuous signal.

Another object of the present invention is to illuminate a tossing disc, a spinning top, a football, a spherical ball, a baton, a hula hoop, a bicycle wheel, or the like while in rotation but to prevent drain on the power source during periods of nonrotation.

Still another object of the present invention is to provide circuitry for achieving this end wherein the centrifugally actuated switches are mercury switches, rolling ball switches, sliding object switches, or the like.

Yet another object of the present invention is to provide the object with a centrifugally actuated visual signal.

Still yet another object of the present invention is to provide the object with a centrifugally actuated audio signal.

A further object of the present invention is to provide an explosive firework wherein a detonation signal is generated after a predetermined rotational speed and duration are attained.

A still further object of the present invention is to dispose the object so that it may be rotated by wind.

A yet further object of the present invention is to dispose the object so that it may be rotated by movement in water.

A still yet further object of the present invention is to dispose the object so that it may be manually rotated.

A yet still further object of the present invention is to provide the object with first and second signal generating means so that, for example, illumination and sound may be simultaneously provided.

An additional object of the present invention is to provide centrifugally actuated signal generating means for an object having two pairs of switches whereby the first pair may be actuated upon rotation about the X axis, the second pair may be actuated upon rotation about the Y axis, and both pairs may be actuated upon rotation about the Z axis.

A further object of the present invention is to provide an object which generates a signal only when in rotation irrespective of the rest position of the object.

Other objectives will appear hereinafter.

These and other objectives are achieved by an object which generates a signal only when in rotation and when in rotation generates a continuous signal comprising a support structure, circuitry mounted to said support structure comprising a power source, a first switch which assumes its ON position in response to centrifugal force, a second switch which assumes its ON position in response to centrifugal force, means for generating a signal, means connecting said power source, said first switch, a second switch, and said means for generating a signal in series, said first switch being mounted to said support structure so that it is in its ON position when said support structure is in rotation, said second switch is being mounted to said support structure so that it is in its ON position when said support structure is in rotation and so that it is in its OFF position when said support structure is not in rotation and when said first switch is in its ON position due to gravity rather than to rotation, whereby said means for generating a signal is actuated only when said support structure is in rotation and whereby when said support structure is in rotation said means for generating a signal is actuated continuously.

BRIEF DESCRIPTION OF THE DRAWINGS

Various other objectives, features and attendant advantages of the present invention will be more fully appreciated as the same becomes better understood by reference to the following detailed description when considered in connection with the accompanying drawings, in which like reference characters designate like or corresponding parts throughout the several views, and wherein.

DESCRIPTION OF THE ILLUSTRATED EMBODIMENTS

As indicated above, one of the objects of the present invention is to provide an object, such as, for example, a toy with circuitry, which will provide continuous illumination during rotation but which will provide no illumination and therefore no drain on the power source during periods of non-rotation. As also mentioned above, it is desirable that no illumination be provided, and therefore no drain on the power source, regardless of the resting position of the object to be illuminated.

Figure 1:
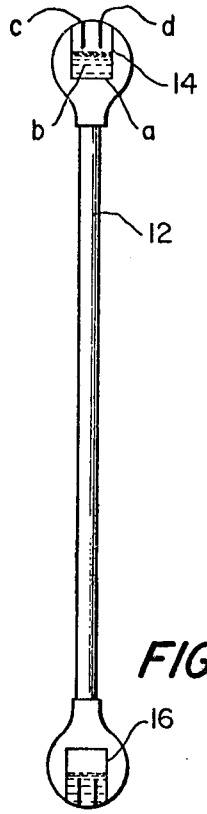
FIG. 1 is a view of the one circuit embodiment of the present invention in its rest position.

FIG. 1 shows a baton provided with circuitry of the instant invention so that it will be illuminated when rotated but will not be illuminated, and will not drain the power source, when not rotating and regardless of its rest position. As shown in FIG. 1, baton 12 is equipped with mercury switches 14 and 16. Mercury switch 14 is comprised of container *a*, electrically conductive mercury *b*, and contacts *c* and *d*. As shown in FIG. 1, the mercury in switch 14 is drawn to the bottom of container *a* by gravity with the result that contacts *c* and *d* are not bridged by the mercury causing an open electrical circuit. Mercury switch 16, on the other hand, has the mercury drawn to the bottom of the container by force of gravity with the result that the contacts are bridged by the electrically conductive mercury. However, as will be seen with reference to FIGS. 3 and 4, both switches 14 and 16 have to be actuated before illumination is provided.

Figure 2:
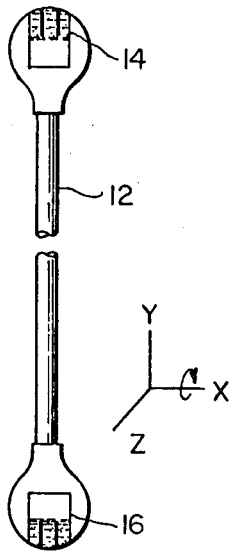
FIG. 2 is a view of the one circuit embodiment of the present invention in rotation.

FIG. 2 shows baton 12 in rotation about the X axis causing the mercury and mercury switches 14 and 16 to bridge the contacts in each switch. This is because the centrifugal force generated by the rotation causes the mercury in switch 14 to bridge the contacts of the mercury switch. As mentioned above, when both mercury switches 14 and 15 are in their ON position, illumination is provided to baton 12.

Figure 3:
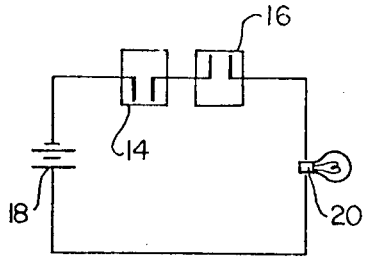
FIG. 3 is a circuit diagram of the one circuit embodiment of the present invention showing the use of one light bulb.

FIG. 3 is a circuit diagram of the circuitry utilized within baton 12 as shown in FIG. 2. As shown in FIG. 3, the circuit consists of power source 18 which may be a small d.c. battery connected in series with switches 14 and 16 and an illumination means, such as, for example, a light bulb 20. Because of the series arrangement, light bulb 20 will not be illuminated when only one of the switches 14 and 16 is in its ON position, such as, for example, its rest position, shown in FIG. 1. Only when both switches are in their ON positions, such as, for example, shown in FIG. 2 will light bulb 20 be illuminated.

Figure 4:
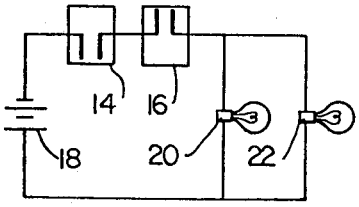
FIG. 4 is a circuit diagram of the one circuit embodiment of the present invention showing the use of a plurality of light bulbs.

FIG. 4 shows a modification of the circuitry of FIG. 3 wherein a light bulb 22 is disposed parallel with light bulb 20 to permit the use of a plurality of illumination means.

It should be noted at this point that the present invention includes not only the use of illumination means actuated by centrifugal force but also other means such as audio generating means, means to impart subsequential motion, and the like.

The one circuit embodiment shown in FIGS. 1 and 2 is quite suitable where rotation is expected about only two of the possible three axes. For example, in FIGS. 1 and 2, switches 14 and 16 will assume their ON positions if there is rotation about the X or Z axis. Rotation about the Y axis, however, will not cause switch 14 to be disposed in its ON position with the result that baton 12 will not be illuminated. However, use of baton 12 is not expected to result in rotation about the Y axis with the result that this contingency need not be provided for.

Other objects, which have expected rotation about no more than two of the three axes for which the one circuit embodiment of the present invention is suitable, are a tossing disc, a spinning top, a hula hoop and a bicycle wheel. Clearly, the scope of the present invention includes other such objects wherein expected rotation is about one or two but not three axes.

A two circuit embodiment of the present invention is suitable for objects wherein rotation may be about any one of the three axes. Such an object may be a spherical ball, another such object may be a football which can be "spiralled" about its longitudinal axis or which may be rotated end-over-end about either of the other two axes.

Figure 5:
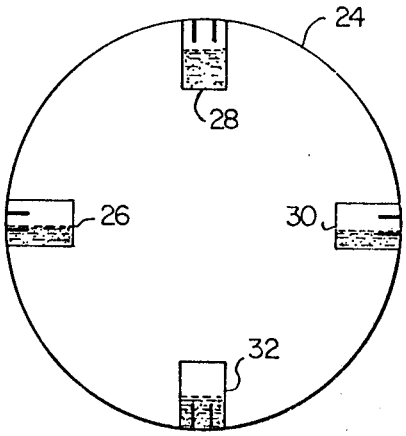
FIG. 5 is a view of the two circuit embodiment of the present invention in its rest position.

FIG. 5 shows a spherical ball 24 equipped with such circuitry of the present invention. Mercury switches 26, 28, 30 and 32 are provided. Illumination will be provided for ball 24 whenever switches 26 and 30 are in their ON positions or whenever switches 28 and 32 are in their ON positions. FIG. 5 shows ball 24 in its rest position wherein only switch 32 is in its ON position due to the force of gravity. Since the force of gravity causes switch 28 to be in its OFF position, as well as switches 26 and 30 to be in their OFF positions, no illumination, and therefore no drain on the power source, occurs when ball 24 is in its rest position.

Figure 6:
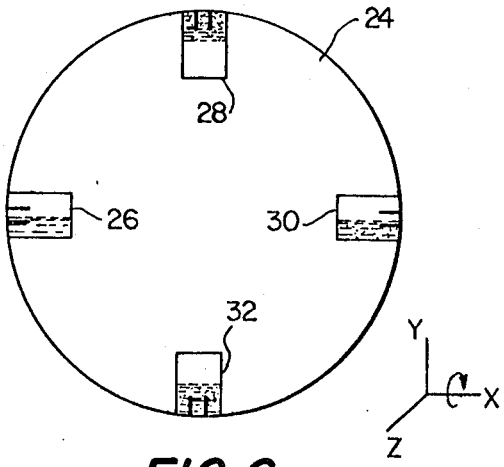
FIG. 6 is a view of the two circuit embodiment of the present invention in rotation about the X axis.

FIG. 6 shows ball 24 when in rotation about the X axis. Centrifugal force caused by rotation about the X axis causes switches 28 and 32 to assume their ON positions causing illumination of ball 24.

Figure 7:
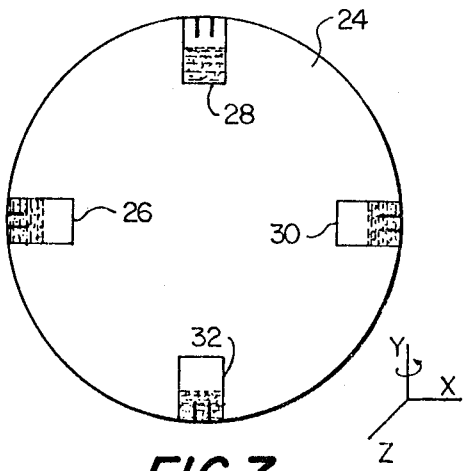
FIG. 7 is a view of the two circuit embodiment of the present invention in rotation about the Y axis.

FIG. 7 shows ball 24 when in rotation about the Y axis. Rotation about the Y axis causes switches 26 and 30 to assume their ON positions causing illumination of the ball 24.

Figure 8:
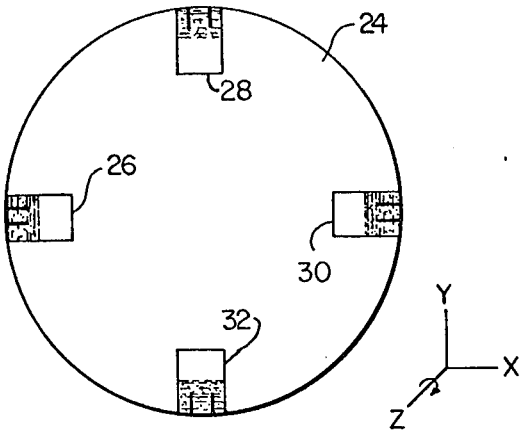
FIG. 8 is a view of the two circuit embodiment of the present invention in rotation about the Z axis.

FIG. 8 shows ball 24 when in rotation about the Z axis. Centrifugal force caused by rotation about the Z axis causes switches 26 and 30, as well as switches 28 and 32, to assume their ON positions resulting in illumination of ball 24.

Figure 9:
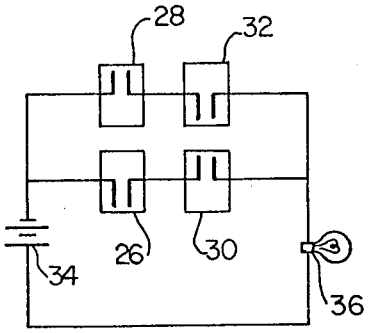
FIG. 9 is a circuit diagram of the two circuit embodiment of the present invention.

FIG. 9 illustrates the circuitry of the two circuit embodiment of the present invention. As shown in FIG. 9, the circuit includes power source 34 which may be a small d.c. battery which is connected to light bulb 36 through two parallel paths consisting of switches 26 and 30, and switches 28 and 32. As is evident from the circuitry, switches 26 and 30, or switches 28 and 32, must be in their ON positions in order to provide illumination of light bulb 36.

Although the one circuit and two circuit embodiments of the present invention described above have been illustrated in conjunction with mercury switches, it is clear other switches responsive to centrifugal force may be utilized.

Figure 10:
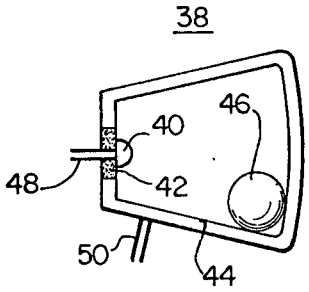
FIG. 10 is a view of a rolling ball switch in its rest position.

FIG. 10 shows a rolling ball switch which may be used in either the one circuit embodiment or the two circuit embodiment of the present invention. As shown in FIG. 10, rolling ball switch 38 consists of electrically conductive contacts 40 and 44 which are respectively connected to electrical lead wires 48 and 50. Contact 40 is insulated from electrically conductive material 44 by non-conductive material 42. FIG. 10 shows switch 38 in its rest position wherein conductive ball 46 does not bridge the gap between contacts 40 and 44 causing the electrical circuit to be open.

Figure 11:
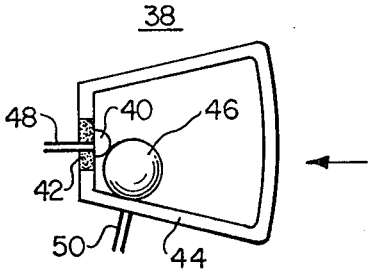
FIG. 11 is a view of a rolling ball switch in its dynamic position.

FIG. 11 shows rolling ball switch 38 in its dynamic position when under the influence of centrifugal force shown in the direction of the arrow. This causes conductive ball 46 to abut contact 40 and thereby bridge the gap betweem contacts 40 and 44 permitting electrical current to flow between electrical lead wires 48 and 50.

Figure 12:
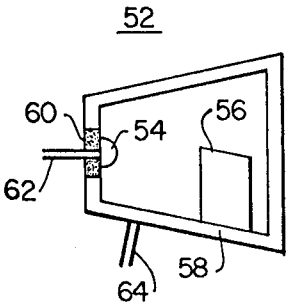
FIG. 12 is a view of a sliding member switch in its rest position.

FIG. 12 shows a sliding member switch 52 which may also be utilized in either the one circuit embodiment or the two circuit embodiment of the present invention. As shown in FIG. 12, sliding member switch 52 consists of electrical contact 54 and electrically conductive material 58 to which electrical lead wires 62 and 64 are respectively attached. Contact 54 is insulated from electrically conductive material 58 by non-conductive material 60. FIG. 12 shows sliding member switch 52 at its rest position wherein sliding member 56 does not bridge the gap between contact 54 and electrically conductive material 58 causing the electrical circuit between electrical lead wires 62 and 64 to be open.

Figure 13:
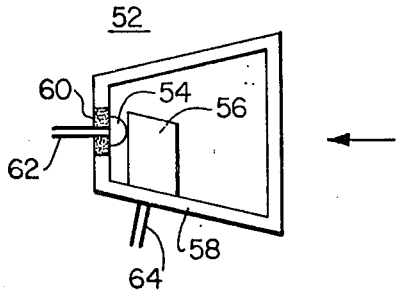
FIG. 13 is a view of a sliding member switch in its dynamic position.

FIG. 13 shows sliding member switch 52 in its dynamic position caused by centrifugal force in the direction indicated by the arrow. The centrifugal force causes conductive member 56 to abut contact 54 and to contact conductive material 58 so as to bridge the gap between contact 54 and electrically conductive material 58 causing a closed circuit to be established between electrical lead wires 62 and 64.

Although the present invention has been described with reference to the illumination of toys during rotation, other applications are also contemplated and are believed to be within the scope of the present invention. For example, the problems encountered with the detonation of fireworks and other hurled explosives may be overcome by utilizing the circuitry of the present invention which could cause detonation of a firework only after it had attained a certain rotational velocity and duration, which would mean that it would establish a certain safe distance from the person throwing the fireworks or explosive.

The circuitry of the present invention could also be utilized to provide a warning if certain conditions were exceeded. Thus, circuitry of the present invention could be utilized in conjunction with a weather vane to indicate when wind velocity exceeded a certain predetermined limit. The switches used in the present invention could be of such a design that they would be actuated only upon attainment of a certain rotational velocity which would correspond to this predetermined wind speed limit.

The circuitry of the present invention can also be utilized to illuminate a boat when in motion by using a water wheel type arrangement which causes rotation only when the boat is moved through the water.

Although applicant has not specifically set forth the manner of mounting the switches of the circuitry of the present invention to the object to be rotated, it is clear that various mountings may be utilized. For example, with reference to the baton shown in FIG. 1, the switches could be connected by a bar which would maintain the fixed relationship between switches 14 and 16 or, alternatively, switches 14 and 16 could be separately mounted at ends of the baton. Similarly, with respect to the ball shown in FIG. 4, a bar can connect switches 28 and 32 and another bar can connect switches 26 and 30 and the two bars may be joined at their center in order to maintain their switches in their respective positions. Alternatively, switches 26, 28, 30 and 32 may be otherwise attached to sphere 24 by adhesives, rivets, or the like.

Figure 14:
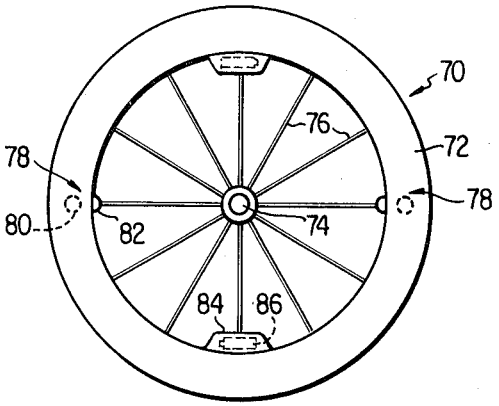
FIG. 14 is a view of the one circuit embodiment of the present invention as embodied within a bicycle wheel.

Still yet further, as noted hereinabove, while the present invention has been described with reference to the illumination of toys during rotation, the same is equally applicable to other rotating objects, such as, for example, wheeled vehicles, particularly a bicycle. With particular reference being made to FIG. 14 for example, there is disclosed a first embodiment of a bicycle wheel, generally indicated by the reference character 70, which includes a rim 72 and an axle 74, a plurality of spokes 76 being interposed therebetween so as to relatively support the same in the conventional manner.

Illumination housings, generally indicated by the reference character 78, are disposed at diametrically opposite positions about wheel 70 and are seen to include mercury switches 80 and light bulbs 82, and electrical power source housings 84, within which are disposed batteries 86, are similarly disposed about wheel 70. The housings 78 and 84 may be integrally formed with wheel 72 or separately fabricated and fixedly secured thereto, batteries 86 being of course electrically connected to switches 80 and bulbs 82 in a manner similar to that of the preceding embodiments, the electrical circuitry not shown, preferably being housed internally of rim 72. It is of course also to be appreciated that the housings 78 and 84 have access means, not shown, whereby the replacement of the light bulbs 82 and batteries 86 may be facilitated, and the bulb hoods might be made of reflectorized material conventionally utilized within automobile tail light housings.

In conjunction with the foregoing, the bicycle illumination system would further comprise a manually operated toggle-type switch, not shown, which would include, for example, three operative positions, the first of which would correspond to an automatically operated mode whereby the illumination means would be automatically energized during motion of the vehicle and automatically extinguished during static conditions of the vehicle. A second position of the switch would correspond to an ON position independent or regardless of motion of the vehicle, and the third position would correspond to an OFF position independent or regardless of motion. During an ON operative mode, when the switch is either in the first or second toggle position, and when the vehicle is in motion, a full circle of light will be generated and such will render the vehicle particularly conspicuous during dark, nighttime periods thereby ensuring or providing the operator with a considerable amount of safety.

The automatically operated mode is of course particularly desirable as the same is peculiarly practical and economical in that battery power will be conserved as a result of deenergization of the system under stopped conditions characteristic of sporadic, local riding, such as, for example, stopping of the vehicle at traffic light intersections, reaching one's destinations in performing a series of errands, and the like. Still further, once the system is set to the first position, or automatic operative mode, a person does not have to be bothered with remembering to activate the same during twilight or nighttime periods as the same will automatically illuminate once the vehicle is in motion. The ON position however is also useful under emergency stopped conditions whereby illumination of the vehicle is desirable, and similarly, during daytime hours, the OFF position is necessary as the illumination of the vehicle under such conditions would be impractical.

Figure 15:
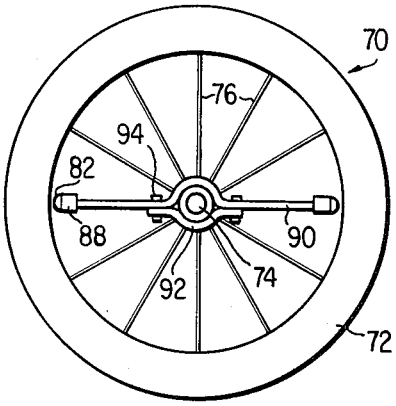
FIGS. 15–19 are further embodiments of the system of FIG. 15 showing modifications of mounting the signal means to the bicycle wheel.

Referring now to FIG. 15, a second embodiment of the bicycle wheel 70 is disclosed wherein it is seen that illumination housings 88 are fixed upon opposite ends of a rigid tube 90 which, in turn, is fixed to axle 74. The housings 88 contain the batteries and mercury switches, not shown, as well as bulbs 82, and the electrical circuitry therefor is internally disposed within tube 90. The central portion of tube 90 is arcuately shaped so as to correspond to and accommodate axle 74, and a similarly configured support bar 92 is likewise disposed about axle 74 and fixedly secured to tube 90 by means of threaded fasteners 94 so as to fixedly retain the assembly upon axle 74.

Figure 16:
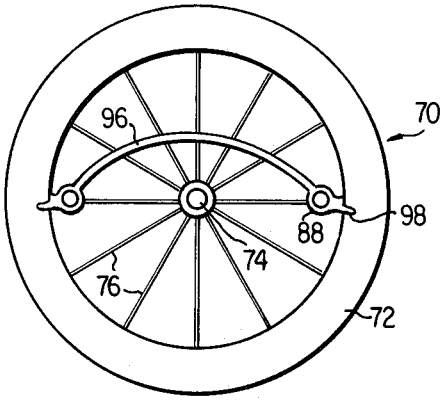

A still further embodiment of the present invention is disclosed within FIG. 16 wherein there is disclosed an embodiment similar to that of FIG. 15, however, in lieu of rigid tube 90, a flexible tube 96, having housings 88 integrally formed upon the end portions thereof, is provided, the length of tube 96 being somewhat greater than the diameter of the wheel 70. The ends of the tube 96 are provided with U-shaped gripping portions 98 which engage the rim 72 in a semi-circular fashion, and in seating the tube upon the wheel 70, the portions 98 are interposed between successive spokes 76. As the normal, non-tensioned state of the tube 96 is a flat or lineal tube, when the same is disposed in its operative state as disclosed within FIG. 16, the resiliency of the same, characteristic of the tensioned state, 1 will tend to return the tube to its non-tensioned state, and in this manner, the tube will be positively fixed with respect to the wheel rim 72.

Figure 17:
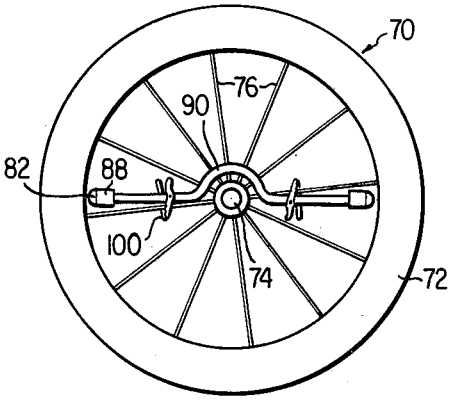
Figure 18:
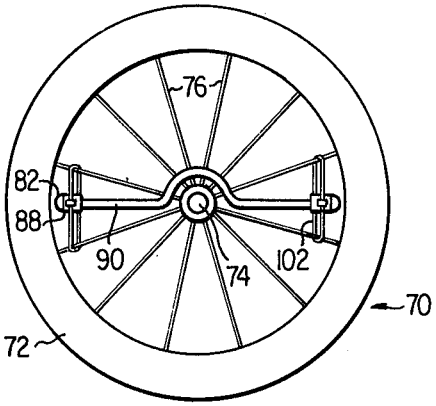
Figure 19:
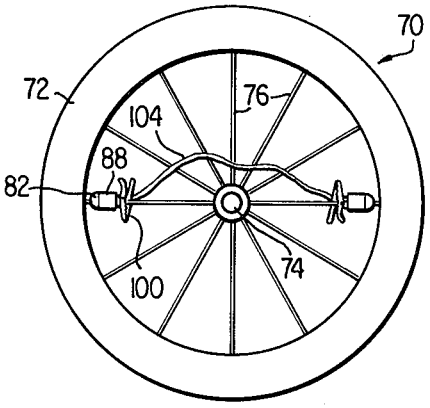

Referring now to FIGS. 17–19, further embodiments of the present invention are disclosed wherein, for example, in conjunction with rigid tube 90, in lieu of support bar 92 for fixedly securing tube 90 to axle 74, tube 90 may alternatively be fixedly secured to the spokes 76 by means of suitable fastening devices, such as, for example, alligator clips 100 fixedly secured to housings 88, or alternatively, elastic straps 102 likewise secured to housings 88. Still further, in lieu of rigid tube 90, a flexible, electrically insulated wire 104 may interconnect housings 88, housings 88 being secured to spokes 76 by, for example, clips 100.

As also noted above, the scope of the present invention is not restricted to solely illumination means but covers the generation of any signal. Another signal which could be utilized would be an audio signal or a motion signal. It is also within the scope of the present invention to provide for the generation of more than one signal. For example, both sound and light could be generated at the same time.

In conjunction with such, suitable sound signal means, not shown, might be added to the previously described apparatus, and such would advantageously be incorporated into the same electrical circuitry operatively associated with the illumination means. An additional four position-toggle-type switch would be provided, and in this manner, the entire device could be completely de-energized when the switch was in the first position, only the lights would be permitted to be energized when the switch was in a second position, only the audible signal would be energized when the switch was in the third position, and both the lights and audible signal would be energized when the switch was in a fourth position. The audible signal would of course find practical application during daytime riding, the audible signal being for example, a low-pitched siren, whereby the same would provide a safety warning signal for children playing on sidewalks or in the streets, pedestrians crossing streets, and the like, and at nighttime, both the audible and visible signals could of course be utilized.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A wheeled object which generates a signal only when in rotation and when in rotation generates a continuous signal, comprising:

wheel support structure;

circuitry mounted upon said wheel support structure including a power source;

switch means including a first switch which can assume its ON position in response to centrifugal force;

said switch means further including a second switch which assumes it ON position in response to centrifugal force;

means for generating a signal;

means connecting electrically in series said power source, said first switch, said second switch, and said means for generating a signal;

said first switch being mounted upon said wheel support structure in a position such that it is in its ON position as a result of centrifugal force generated when said support structure is in rotation about a given axis; and said second switch is mounted upon said wheel support structure in a position such that it is in its ON position as a result of centrifugal force generated when said support structure is in rotation about said axis and so that it is in its OFF position when said support structure is not in rotation and when said first switch is in its ON position due to gravity rather than to rotation, whereby said means for generating a signal is actuated only when said wheel support structure is in rotation and whereby when said support structure is in rotation said means for generating a signal is actuated continuously.

2. A wheeled object as set forth in claim 1, wherein: said wheel support structure comprises a wheel rim.

3. A wheeled object as set forth in claim 2, wherein:

said circuitry, said switch means, and said means for generating a signal are mounted within said wheel rim.

4. A wheeled object as set forth in claim 2, further comprising:

flexible, resilient tube means for resiliently engaging said wheel rim;

said circuitry, said switch means, and said means for generating a signal being mounted within and upon said flexible tube.

5. A wheeled object as set forth in claim 4, wherein:

said flexible tube means has a length larger than the diameter of said wheel rim so as to cause said tube to reside in a compressed state when said tube resiliently engages said wheel rim.

6. A wheeled object as set forth in claim 4, wherein:

said flexible tube means includes U-shaped gripping members for engaging and gripping said wheel rim.

7. A wheeled object as set forth in claim 1, wherein:

said wheel support structure comprises a wheel axle.

8. A wheeled object as set forth in claim 7, further comprising:

rigid tube means fixedly engaged with said axle;

said circuitry, said switch means, and said means for generating a signal being mounted within and upon said rigid tube.

9. A wheeled object as set forth in claim 7, further comprising:

support bar means fixedly engaged with said axle upon the side thereof which is opposite the side upon which said rigid tube is engaged; and fastening means fixedly interconnecting together with said rigid tube and said support bar.

10. A wheeled object as set forth in claim 1, wherein:

said wheeled object is a bicycle wheel.

11. A wheeled object as set forth in claim 10, wherein:

said wheel support structure comprises spokes.

12. A wheeled object as set forth in claim 11, further comprising:

rigid tube means fixedly secured to said spokes;

said circuitry, said switch means, and said means for generating a signal being mounted within and upon said rigid tube.

13. A wheeled object as set forth in claim 12, further comprising:

means for fixedly securing said rigid tube means to said spokes.

14. A wheeled object as set forth in claim 13, wherein:

said securing means comprises alligator clips.

15. A wheeled object as set forth in claim 13, wherein:

said securing means comprises elastic straps.

16. A wheeled object as set forth in claim 11, further comprising:

flexible wire means fixedly secured to said spokes;

said circuitry, said switch means, and said means for generating a signal being mounted within and upon said flexible wire means.

* * * * *